United States Patent [19]

Wozniak

[11] 4,448,349

[45] May 15, 1984

[54] RAIL SLEEPERS WITH RAIL CLAMPING DEVICES

[75] Inventor: Jan C. Wozniak, Thorneville, Isle of Man

[73] Assignee: Serni Limited, Douglas, Isle of Man

[21] Appl. No.: 315,939

[22] Filed: Oct. 28, 1981

[30] Foreign Application Priority Data

Nov. 1, 1980 [GB] United Kingdom ..... 8035201

[51] Int. Cl.[3] ..... E01B 3/16; E01B 9/32

[52] U.S. Cl. ..... 238/62; 238/334; 238/349; 238/350

[58] Field of Search ..... 238/62–64, 238/349, 350, 38, 39, 54, 59, 60, 61, 70–72, 81, 310, 331, 334, 338

[56] References Cited

U.S. PATENT DOCUMENTS

| | | | |
|---|---|---|---|
| 1,225,503 | 5/1917 | Salter | 238/350 X |
| 1,380,235 | 5/1921 | Moell | 238/59 |
| 1,434,823 | 11/1922 | Jicha | 238/70 X |
| 3,831,842 | 8/1974 | Tamura | 238/349 |
| 4,106,696 | 8/1978 | Andersson | 238/350 X |

FOREIGN PATENT DOCUMENTS

| | | | |
|---|---|---|---|
| 648369 | 7/1937 | Fed. Rep. of Germany | 238/349 |
| 854755 | 11/1960 | United Kingdom | 238/349 |

*Primary Examiner*—Randolph Reese

*Attorney, Agent, or Firm*—Louis E. Marn; Elliot M. Olstein

[57] ABSTRACT

There is disclosed a rail sleeper which when secured to rails affords rapid disengagement when necessary and is comprised of a metal bar of a U-shaped channel section. At two locations along the length of the bar portions of flanges of the sleeper are removed to provide slots disposed at right angles to the longitudinal axis of the bar. Each slot is wider than the base of the rail fitting thereinto with the space between slots dependent upon the gage between parallel rails and with the depth of such slots being varied to suit rail height. One rail flange is secured in place by an overhanging portion of the sleeper flanges. The other rail flange is secured by a generally T-shaped steel plate which is bolted to the bottom of the U-shaped channel section such that the horizontal bar of the T-shaped plate rests across the upright flanges of the sleeper. One edge of the horizontal bar engages the web of the rail and the other edge engages the edge of the slot, thus wedging the rail into secure engagement.

3 Claims, 4 Drawing Figures

RAIL SLEEPERS WITH RAIL CLAMPING DEVICES

Where a railway track is to form part of a permanent transport system, there are several methods of attaching the rails to the sleepers and securing them against the effects of vibration caused by the passage of the rail traffic. One such system is to use components such as U-shaped steel chairs which are bolted to the sleepers, the rail itself is located between the uprights of the U-shape and is secured in that position by wooden wedges driven between the chair uprights and the web of the rail section. This and other similar systems are suitable and adequate for the duties they have to perform because the rail track is to be permanent, thus the length of time needed to install the sleepers and attach the rails are not of great importance.

There are rail transport systems however where the track is not permanent but needs to be dismantled and relaid again at frequent intervals of time; these circumstances occur in many of the extractive industries such as mining, quarrying, forestry, etc. For example, in the mining industry, the excavated mineral is loaded into wagons which are coupled together to form a train which is hauled along the rail transport system to the mine exit. In a similar manner, the mining supplies are sent to the areas of mineral extraction in rail mounted trolleys. When a particular area of mineral has been extracted, it is necessary to dismantle the track and transport it to a new location where it is relaid and ready to be used once again. This cycle of laying and recovering rail track may be repeated several times in a year so the need for a device which will allow the rails to be quickly clamped or released from the rail sleeper is evident.

In addition to the above, other special conditions exist in the mining industry which require the frequent relaying of rail track and also cause the loosening of the rail attachment device with consequent dislodgement of the rail leading to dangerous accidents. These conditions are created by the effects of strata pressures which cause floor upheaval and distortion thus making the task of regrading track and inspection a constant problem.

The present invention relates to rail sleepers which incorporate devices for gripping the rails in such a manner that vibrational dislodgement of the rail will be extremely difficult yet at the same time allowing the rail system to be easily dismantled in order to be transported and relaid at a new location where it can be quickly assembled.

The object of the present invention is to provide a rail sleeper which will secure the rails and afford rapid disengagement when necessary and will comprise a metal (e.g. steel) bar of a U-channel section. At two locations along the length of the bar, portions of the flanges are removed to provide slots cut at right-angles to the longitudinal axis of the bar. Each slot is wider than the base of the rail which will fit into it, while the space between the two slots will depend upon the gauge between the parallel rails and the depth of the slots will be varied to suit the height of the rails to be inserted into the slots.

Within each cut-out slot, the opposing, exposed flanges of the U-section are cut to form particular profiled shapes. The faces at one side are cut at an angle to form a recess into which can be fitted the base of the rail section such that it will be prevented from vertical movement; the other faces of the flanges on the opposite side are sloped at an obtuse angle to the base of the U-section bar.

When the rail is placed in the slot with one rail flange located within the angled recess, the other flange of the rail is held in place by a generally T-shaped steel plate with the horizontal bar of the T resting across the flanges of the slots and overlaying the rail flange. While the upper edge of the T-bar abuts the web of the rail section, the lower edge of the T-bar abuts the sloping face of the cut-out slot. The vertical stem of the T-bar is bent through an angle of 90 degrees such that the foot rests on the base of the U-section bar.

A hole is provided in the T-shape such that a bolt can be passed through it to connect and thread onto a nut which is attached to the base of the U-section bar. When this bolt is tensioned, the bottom edge of the horizontal T-bar is forced down the sloping face of the slot flanges such that a wedge action causes the T-bar to push the web of the rail section and thereby force the flange of the rail into the angled recess. If the angle of the sloping face is varied a desired degree of clamping can be obtained.

In order that the invention may be fully understood and readily carried into effect, a preferred embodiment thereof will now be described, by way of example only, with reference to the drawings which accompany this specification in which.

Figure 2:
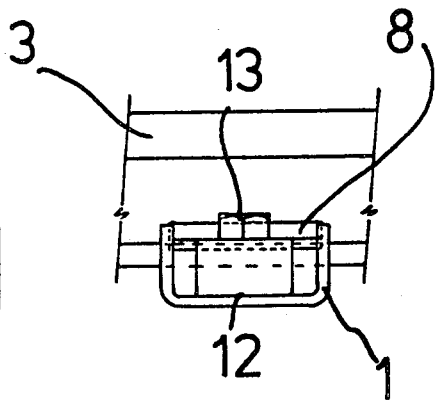
FIG. 2 shows an End Elevational View of the invention with the two rails in position.
Figure 1:
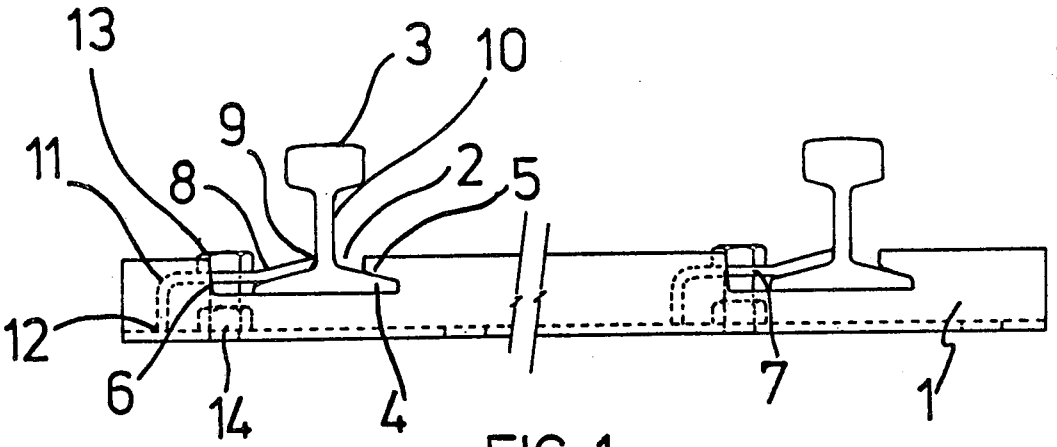
FIG. 1 shows a Front Elevational View of the invention with the two rails in position.
Figure 3:
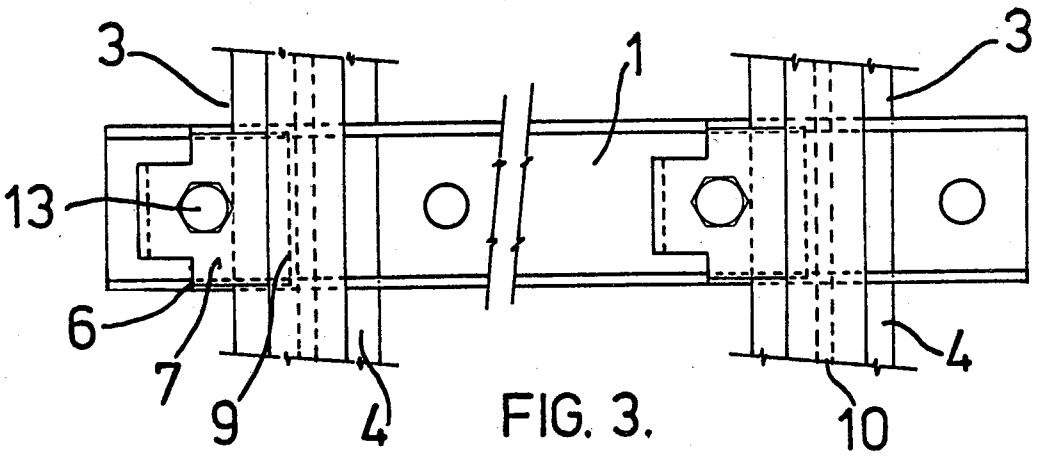
FIG. 3 shows a Plan View of the invention with the rails in position.
Figure 4:
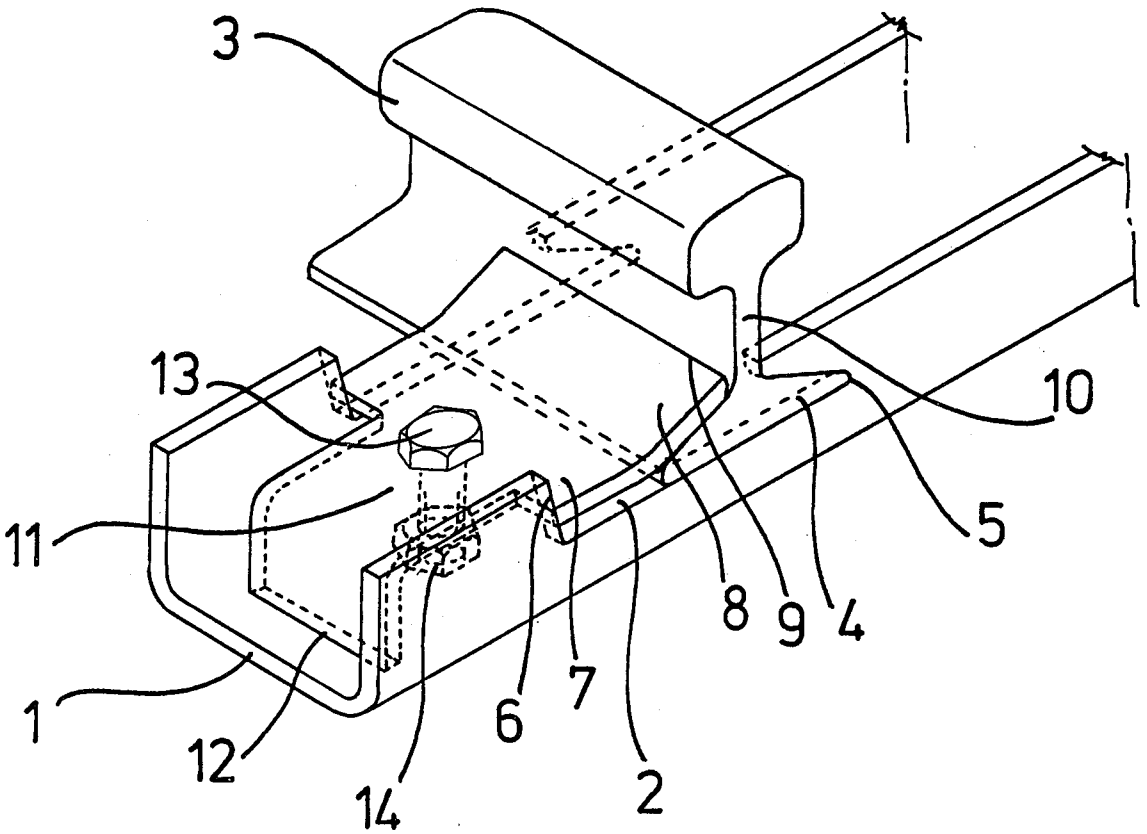
FIG. 4 shows a Pictorial View of the invention with the two rails in position.

A U-section bar 1 has two slots 2 cut into the flanges of the U-shape in order to accommodate inserted rails 3. One of the rail flanges 4 is located within recess 5 which has been formed in the face of the exposed U-section flange; the face of the opposite flange has a sloping face 6. A generally T-shaped steel plate 7 has its horizontal bar 8 overlaying the flange of the rail with its upper edge 9 abutting the web of the rail 10 and the lower edge of the horizontal T in contact with the sloping face 6. The stem 11 of the T-shape is bent through an angle of 90 degrees such the the foot 12 of the stem rests on the base of the U-shaped section. A hole located in the body of the T-shape allows a bolt 13 to pass through it and angage with an attached nut 14.

What we claim is:

1. A rail securement arrangement including a rail sleeper and means for gripping a pair of rails, each rail having first and second flange portions, said arrangement comprising:

a metallic U-shaped channel member including a base section with at least one orifice formed therein, and having flanged sections formed with slots at substantially a right angle to the longitudinal axis of said channel member for receiving said rail; said slots formed with a recessed portion to receive said first flange portion of said rail and a sloped portion opposite said recessed portion;

a T-shaped plate member and including an orifice, said T-shaped plate member being disposed in said slots in contact with said sloped portion of said slots and with said second flange portion of said rail; and bolt means positioned through said orifice of said T-shaped member and said orifice in said base section of said channel member whereby tensioning of said bolt means causes said T-shaped plate member to push against said sloped portion of said slots and thus against said second flange of said rail thereby forcing said first flange portion of said rail into said recessed portion of said slots.

2. The rail securement arrangement as defined in claim 1 wherein said sloped portion of said slots is varied to provide a desired degree of rail clamping.

3. The rail securement arrangement as claimed in claim 2 wherein said T-shaped plate member is formed with a stem along the longitudinal axis of said U-shaped channel member having for contacting said base section of said U-shaped channel member to provide stability and counteract effects of vibration.

* * * * *